US012433368B1

(12) United States Patent
He et al.

(10) Patent No.: US 12,433,368 B1
(45) Date of Patent: Oct. 7, 2025

(54) SHOE FOR AUTOMATICALLY ADJUSTING AND SUPPORTING FOOT ARCH

(71) Applicants: Soonling Lim, Guangzhou (CN); Wenzhi He, Bengbu (CN)

(72) Inventors: Wenzhi He, Bengbu (CN); Soonling Lim, Guangzhou (CN)

(73) Assignee: Soonling Lim, Guangzhou (CN)

( * ) Notice: Subject to any disclaimer, the term of this patent is extended or adjusted under 35 U.S.C. 154(b) by 0 days.

(21) Appl. No.: 19/030,291

(22) Filed: Jan. 17, 2025

(30) Foreign Application Priority Data

Jan. 7, 2025 (CN) ..... 202520027810.X

(51) Int. Cl.

| | |
|---|---|
| ***A43B 13/18*** | (2006.01) |
| ***A43B 7/142*** | (2022.01) |
| ***A43B 7/22*** | (2006.01) |
| ***A43B 13/14*** | (2006.01) |

(52) U.S. Cl.
CPC ..... *A43B 13/141* (2013.01); *A43B 7/22* (2013.01); *A43B 13/187* (2013.01); *A43B 7/142* (2013.01)

(58) Field of Classification Search
CPC ..... A43B 7/142; A43B 7/1463; A43B 7/223; A43B 7/22; A43B 13/188; A43B 13/181; A43B 13/38
USPC ..... 36/153
See application file for complete search history.

(56) References Cited

U.S. PATENT DOCUMENTS 788,469 A * 4/1905 Huether ..... A43B 7/142 36/155
1,346,059 A * 7/1920 Robson ..... A43B 7/1467 36/158
1,676,162 A * 7/1928 Schiller ..... A43B 7/22 36/153
2,043,396 A * 6/1936 Schnellbacher ..... A43B 7/223 36/158
2,139,971 A * 12/1938 Pava ..... A43B 7/142 36/141
2,510,654 A * 6/1950 Pepin ..... A43B 7/226 36/94
4,227,320 A * 10/1980 Borgeas ..... A43B 17/03 36/71

(Continued)

FOREIGN PATENT DOCUMENTS

| | | |
|---|---|---|
| CN | 208096169 U | 11/2018 |
| CN | 220255820 U | 12/2023 |
| CN | 220403239 U | 1/2024 |

*Primary Examiner* — Alissa L Hoey
*Assistant Examiner* — Akwokwo Olabisi Redhead
(74) *Attorney, Agent, or Firm* — JEEN IP LAW, LLC

(57) ABSTRACT

The present invention discloses a shoe for automatically adjusting and supporting a foot arch, including: a shoe body; an elastic arch support member disposed in an interior of the shoe body, where the elastic arch support member includes an associated midsole, a foot arch support curved surface block disposed on the associated midsole, a spring body; several elastic straps disposed between an outer edge of the foot arch support curved surface block and the interior of the shoe body; and further including a pressure-bearing plate independently disposed between the associated midsole and an inner bottom portion of the shoe body. In the present invention, the foot arch support curved surface block is adapted to the foot arch, and the spring body and the elastic strap that have a flexible and adjustable function are disposed.

8 Claims, 10 Drawing Sheets

(56) References Cited

U.S. PATENT DOCUMENTS

| | | | | |
|---|---|---|---|---|
| 5,918,338 | A * | 7/1999 | Wong | A43B 13/37<br>12/146 S |
| 6,021,588 | A * | 2/2000 | Alviso | A43B 13/12<br>36/102 |
| 6,301,807 | B1 * | 10/2001 | Gardiner | A61F 5/14<br>36/43 |
| 6,732,457 | B2 * | 5/2004 | Gardiner | A43B 13/38<br>36/43 |
| 6,976,322 | B1 * | 12/2005 | Walker | A43B 7/223<br>36/43 |
| 2009/0188129 | A1 * | 7/2009 | Fusco | A43B 7/144<br>36/44 |
| 2010/0050322 | A1 * | 3/2010 | Zagula | A43B 7/142<br>36/153 |

* cited by examiner

A-A

SHOE FOR AUTOMATICALLY ADJUSTING AND SUPPORTING FOOT ARCH

CROSS-REFERENCE TO RELATED APPLICATIONS

The application claims priority to Chinese patent application No. 202520027810X, filed on Jan. 7, 2025, the entire contents of which are incorporated herein by reference.

TECHNICAL FIELD

The present invention relates to the technical field of foot arch support, and in particular to, a shoe for automatically adjusting and supporting a foot arch.

BACKGROUND

The shoe usually includes a shoe sole, an insole and an upper, where the top of the sole is usually flat for placing the insole. The traditional insole is also flat, which cannot support the whole sole of the foot, and the support weight is mostly concentrated at two parts of the front sole and the heel, the foot arch is basically not stressed or is small in stress, resulting in a small stress area and uneven stress of the entire sole. The foot arch support pad for foot arch support can contact and support the foot arch only when the foot arch is pressed down, which makes it difficult to adapt to the height difference of the foot arch and the requirements for foot arch support in different gaits, and therefore, a shoe for automatically adjusting and supporting a foot arch is proposed.

SUMMARY

The present invention aims to provide a shoe for automatically adjusting and supporting a foot arch. In this device, the foot arch support curved surface block is adapted to the foot arch, and the spring body and the elastic strap that have a flexible and adjustable function are disposed, so that the device can match the change of a contact curved surface of a human body foot arch instantaneously according to height difference of the human body foot arch and different gaits, and a stress applied to the entire sole tends to be uniform and a stress area tends to maximize efficacy, and in addition, the foot arch can be flexibly supported and the size of the foot arch support force and the stress area can be changed as the gait changes.

To achieve the above objectives, the present invention provides a technical solution as follows: a shoe for automatically adjusting and supporting a foot arch, including: a shoe body; an elastic arch support member disposed in an interior of the shoe body and used for foot arch adaptive support, where the elastic arch support member includes an associated midsole, a foot arch support curved surface block disposed on the associated midsole, and a spring body; several elastic straps disposed between an outer edge of the foot arch support curved surface block and the interior of the shoe body, where the foot arch support curved surface block is in direct contact with a human body foot arch, the spring body is adapted to an inner bottom of the foot arch support curved surface block, and the spring body and the several elastic straps flexibly adjust a support force at the foot arch jointly; and further including a pressure-bearing plate independently disposed between the associated midsole and an inner bottom portion of the shoe body and used for bearing the support force when a gait of the foot arch changes.

Preferably, the foot arch support curved surface block is adapted to a shape of the human body foot arch, and a thickness of the foot arch support curved surface block gradually decreases from a middle to two ends.

Preferably, the spring body is disposed at a lower edge of a middle bottom curved surface of the foot arch support curved surface block and has a thickness adapted to the foot arch support curved surface block, and the thicknesses of the spring body and the foot arch support curved surface block gradually decrease from the middle to the two ends.

Preferably, an outer edge of the foot arch support curved surface block is provided with several connecting members, the several connecting members are in one-to-one correspondence with the several elastic straps, one end of each elastic strap passes through the connecting member to be connected to the foot arch support curved surface block, and the other end of each elastic strap is connected to an inner upper portion of the shoe body.

Preferably, a connection manner between the elastic strap and the interior of the shoe body may be thread stitching or adhesive connection.

Preferably, the associated midsole is fixedly connected to the foot arch support curved surface block and the spring body through machine stitching or adhesive bonding.

Preferably, the associated midsole is fixedly connected to the interior of the shoe body or a vamp of the shoe body in a thread stitching manner.

Preferably, the spring body is made of a high-elasticity material; and the pressure-bearing plate is made of a high support material.

Compared with the prior art, beneficial effects of the present invention are as follows:

1. In the present invention, the foot arch support curved surface block is adapted to the foot arch, and the spring body and the elastic strap that have a flexible adjustable function are disposed, so that the device can match the change of a contact curved surface of a human body foot arch instantaneously according to height difference of the human body foot arch and different gaits. A defect of the traditional foot arch support is broken, which can be contacted and supported only when the foot arch is pressed down. In this design, the foot arch support function is achieved, and the size of the pressure of the foot arch support curved surface block is changed according to the gait, so as to flexibly adjust the support of the foot arch.
2. Through the effective support at the foot arch, the stress area of the whole sole can be effectively increased, so that the stress area of the sole tends to be maximized, the stress size tends to be uniform, and the whole foot is protected and fatigue-resistant, so as to overcome the problems that the support force of a traditional shoe is mainly concentrated on the two parts of the front sole and the heel, and the foot arch is basically not stressed or is small in stress, and the comfort degree and the protection degree of the whole foot in the gait are improved.

Figure 1:
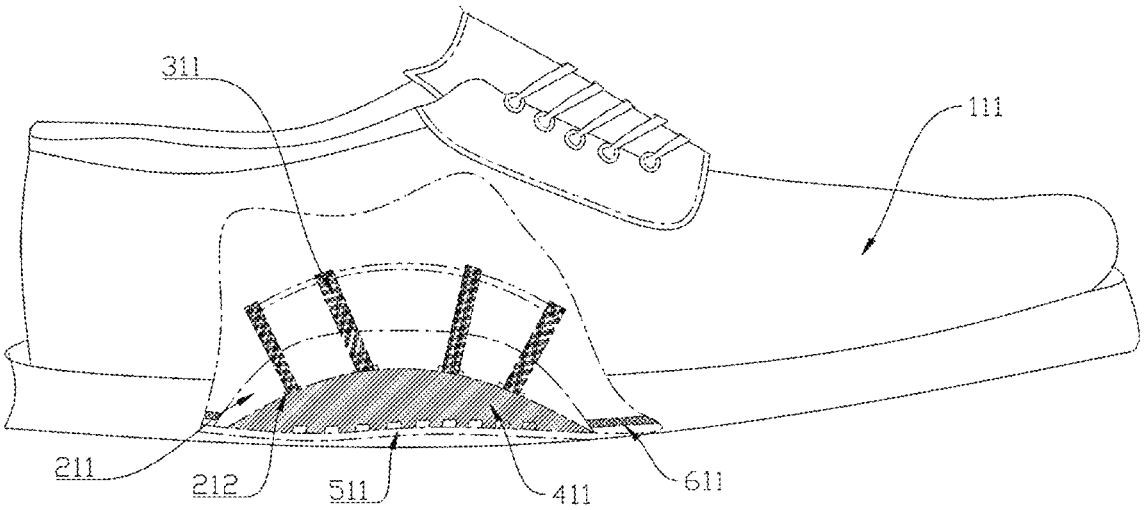
FIG. 1 is a schematic structural diagram of the present invention.

In the figures: 111. shoe body; 211. foot arch support curved surface block; 212. connecting member; 311. elastic strap; 411. spring body; 511. pressure-bearing plate; 611. associated midsole.

DETAILED DESCRIPTION OF THE EMBODIMENTS

In the description of the present invention, it should be understood that, the orientations or positional relationships indicated by the terms "length", "width", "up", "down", "front", "back", "left", "right", "vertical", "horizontal", "top", "bottom", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. The embodiments of the present invention are described in detail below with reference to the accompanying drawings.

Referring to FIG. 1 to FIG. 10, the present invention preferably provides a technical solution: a shoe for automatically adjusting and supporting a foot arch, including: a shoe body 111; an elastic arch support member disposed in an interior of the shoe body 111 and used for foot arch adaptive support, where the elastic arch support member includes an associated midsole 611, a foot arch support curved surface block 211 disposed on the associated midsole 611, and a spring body 411; several elastic straps 311 disposed between an outer edge of the foot arch support curved surface block 211 and the interior of the shoe body 111, where the foot arch support curved surface block 211 is in direct contact with a human body foot arch, the spring body 411 is adapted to an inner bottom of the foot arch support curved surface block 211, and the spring body 411 and the several elastic straps 311 flexibly adjust a support force at the foot arch jointly; and further including a pressure-bearing plate 511 independently disposed between the associated midsole 611 and an inner bottom portion of the shoe body 111 and used for bearing the support force when a gait of the foot arch changes.

Figure 2:
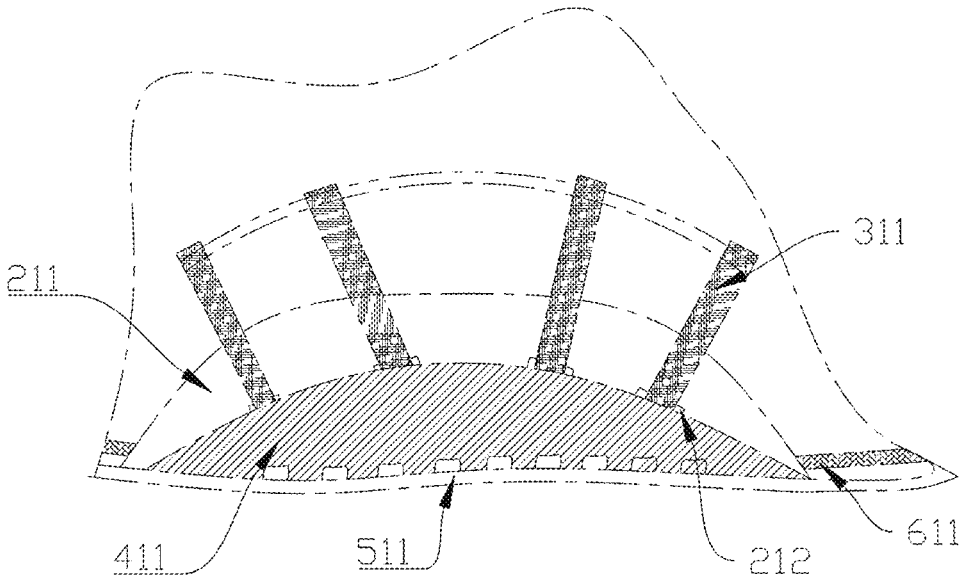
FIG. 2 is a schematic diagram of a partially enlarged structure in FIG. 1.
Figure 3:
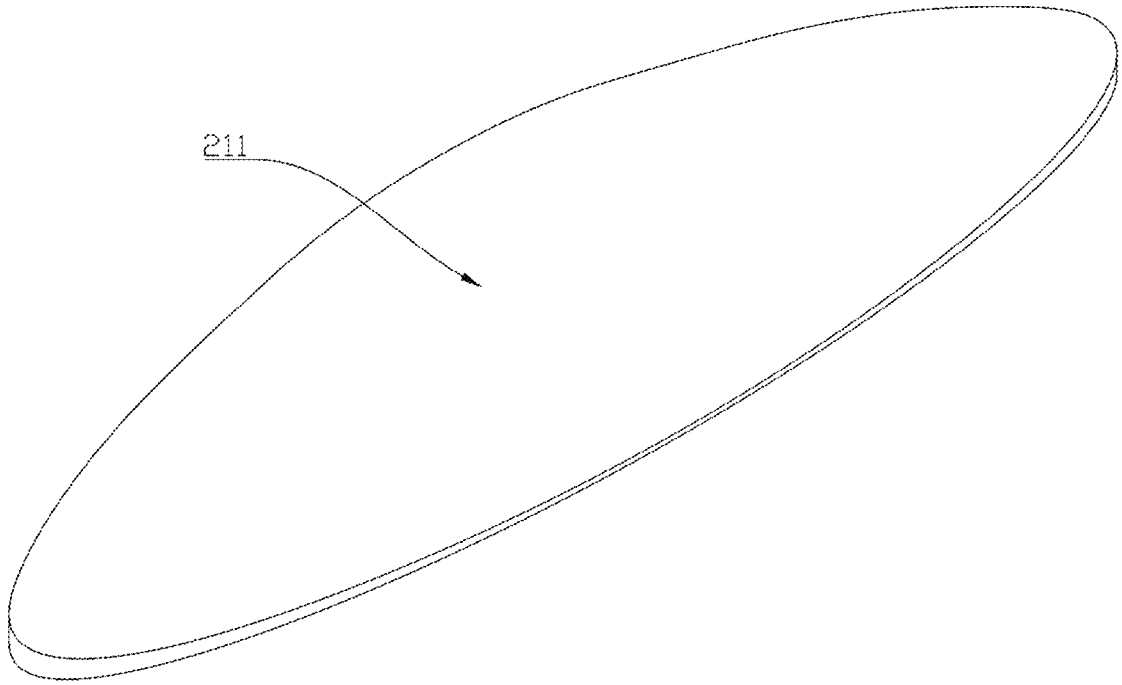
FIG. 3 is a schematic diagram of an enlarged structure of a foot arch support curved surface block.
Figure 4:
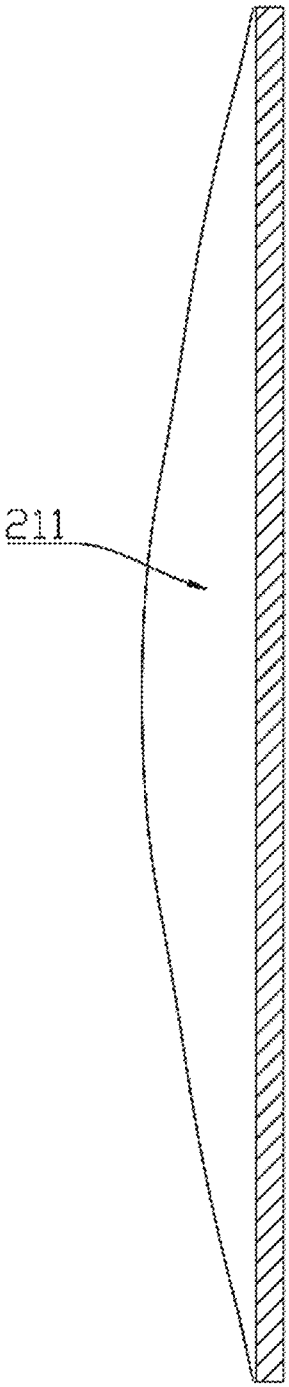
FIG. 4 is a schematic diagram of a cross-sectional structure of A-A in FIG. 3.
Figure 5:
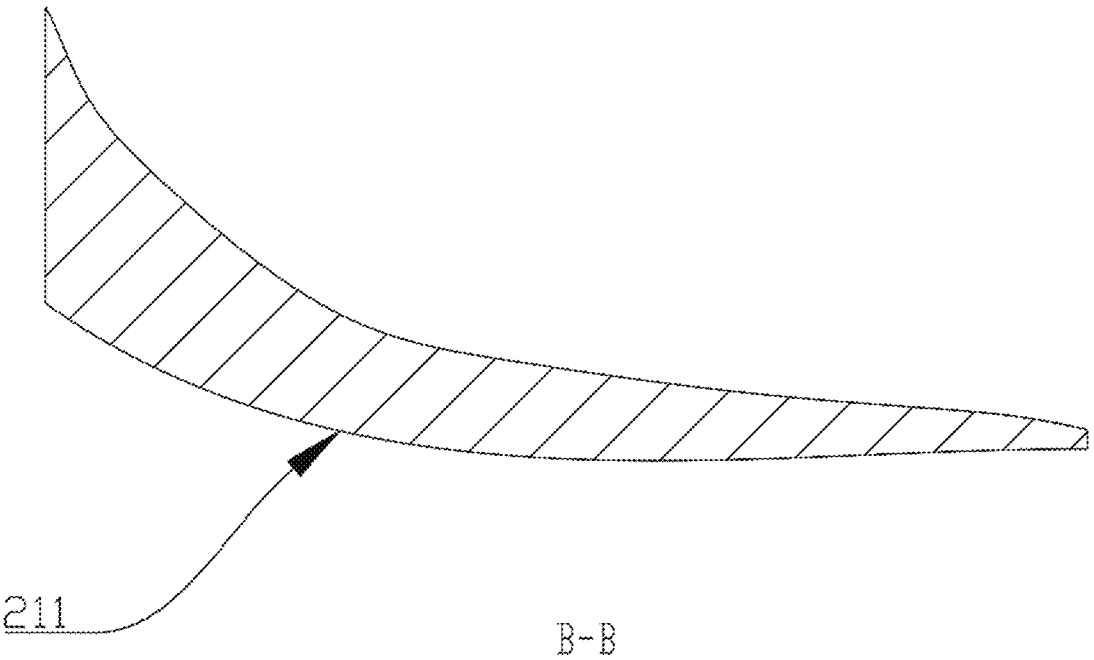
FIG. 5 is a schematic diagram of a cross-sectional structure of B-B in FIG. 3.
Figure 6:
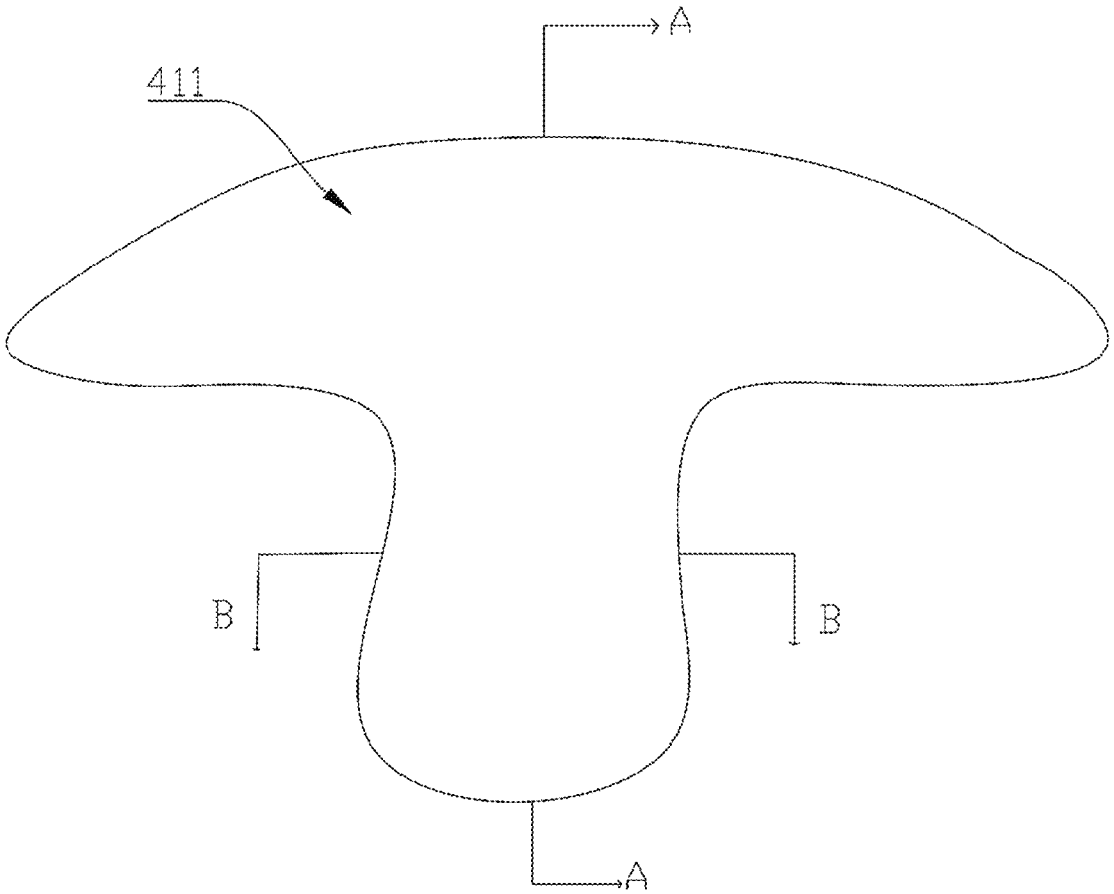
FIG. 6 is a schematic diagram of an enlarged structure of a spring body.
Figure 7:
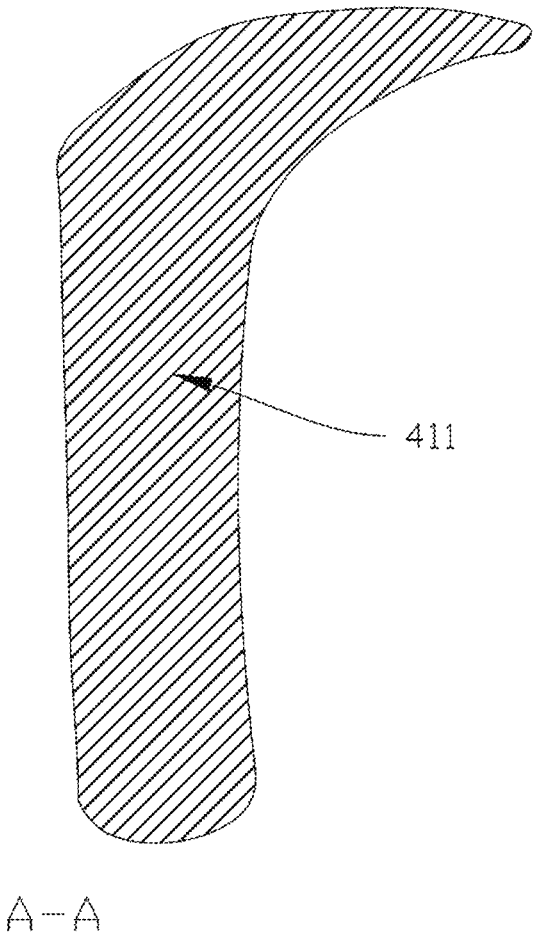
FIG. 7 is a schematic diagram of a cross-sectional structure of A-A in FIG. 6.
Figure 8:
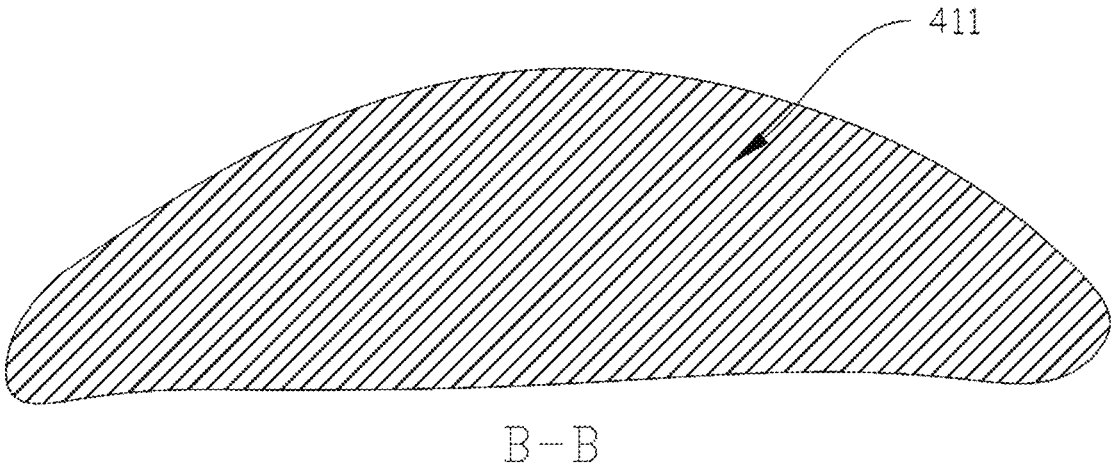
FIG. 8 is a schematic diagram of a cross-sectional structure of B-B in FIG. 6.

In the present application, the foot arch support curved surface block 211 constitutes a structural body for supporting the foot arch, which is in direct contact with the foot arch; the spring body 411 and the elastic strap 311 together form a structural body with a flexible and adjustable function; the associated midsole 611 is disposed, so that the spring body 411 and the foot arch support curved surface block 211 form a whole; in addition, in a gait change, the pressure-bearing plate 511 can bear a downward pressure generated at the foot arch and an upward elastic force released by the spring body 411 during a rebound process;

thus, when the foot arch support curved surface block 211 is in effective contact with the foot arch and the foot lifting or foot pressing is performed, the foot arch support curved surface block 211 may actively contact the foot arch and is always attached to the foot arch; in this design, a defect of the traditional foot arch support is broken, which can be contacted and supported only when the foot arch is pressed down; and in this design, the foot arch support function is achieved, and the size of the pressure of the foot arch support curved surface block 211 is changed according to the gait, so as to flexibly adjust the support of the foot arch, and specifically, in conjunction with FIG. 1 and FIG. 2, when the foot is pressed down, the pressure of the foot arch on the foot arch support curved surface block 211 is increased, the deformation degree of the spring body 411 and the elastic strap 311 is increased, the rebound force of the spring body and the elastic strap on the foot arch is increased, and the support force is improved;

similarly, when the foot is lifted up, the foot arch support curved surface block 211 is reduced in stress, the deformation degree of the spring body 411 and the elastic strap 311 is reduced, and the support force for the foot arch is also adaptively reduced, and therefore, in this design, the size of the support force and the rebound force can be instantaneously and flexibly changed according to the pressure change of the foot arch, and the pressure change of the foot arch may be derived from reasons such as height difference of the human body foot arch, gait change, human body weight, and the like;

in addition, in this design, through the effective support at the foot arch, the stress area of the whole sole can be effectively increased, so that the no matter whether the device is in the process of starting or falling, and when the stress of the foot arch and the entire sole changes, according to this design, the non-uniformity of the stress of the foot arch of the sole at each position point is instantaneously and flexibly adjusted to be uniform, and the peak value and the valley value of the stress are adjusted to tend to be an average value, so that the stress area of the sole tends to be maximized, the stress size tends to be uniform, and the whole foot is protected and fatigue-resistant, so as to overcome the problems that the support force of a traditional shoe is mainly concentrated on the two parts of the front sole and the heel, and the foot arch is basically not stressed or is small in stress, and the comfort degree and the protection degree of the whole foot in the gait are improved; and in this design, the foot arch support curved surface block 211 is adapted to the foot arch, and the spring body 411 and the elastic strap 311 that have a flexible and adjustable function are disposed, so that the device can match the change of a contact curved surface of a human body foot arch instantaneously according to height difference of the human body foot arch and different gaits, and a stress applied to the entire sole tends to be uniform and a stress area tends to maximize efficacy, and in addition, the foot arch can be flexibly supported and the size of the foot arch support force and the stress area can be changed as the gait changes.

Further, the foot arch support curved surface block 211 is adapted to a shape of the human body foot arch, and a thickness of the foot arch support curved surface block gradually decreases from a middle to two ends, and as shown in FIG. 1, FIG. 3, FIG. 4, and FIG. 5, effective contact between the foot arch support curved surface block 211 and the foot arch is realized.

Further, the spring body 411 is disposed at a lower edge of a middle bottom curved surface of the foot arch support curved surface block 211 and has a thickness adapted to the foot arch support curved surface block 211, and the thicknesses of the spring body and the foot arch support curved surface block gradually decrease from the middle to the two ends.

As shown in FIG. 1, FIG. 2, FIG. 6, FIG. 7, and FIG. 8, the spring body 411 is attached to the lower edge of a middle bottom curved surface of the foot arch support curved surface block 211, so as to buffer the foot arch support curved surface block 211 when the foot arch support curved surface block 211 is pressed and reset the foot arch support curved surface block 211 when the foot arch support curved surface block 211 is depressurized, so that the foot arch support curved surface block 211 and the foot arch are kept in a contact state all the time, and a real-time support effect of the device is ensured.

Further, an outer edge of the foot arch support curved surface block 211 is provided with several connecting members 212, the several connecting members 212 are in one-to-one correspondence with the several elastic straps 311, one end of each elastic strap 311 passes through the connecting member 212 to be connected to the foot arch support curved surface block 211, and the other end of each elastic strap is connected to an inner upper portion of the shoe body 111.

As shown in FIG. 2, since one end of the elastic strap 311 is connected to the shoe body 111, a reset process after being pressed the foot arch support curved surface block 211 connected to the other end of the elastic strap 311 can be realized. It should be noted that the connecting member 212 herein may be selected as a through hole or a recessed step portion, and the recessed step portion is provided with a mounting member, so that the elastic strap 311 passes through.

Further, a connection manner between the elastic strap 311 and the interior of the shoe body 111 may be thread stitching or adhesive connection, and as shown in FIG. 1 and FIG. 2, in order to ensure stability, preferably the thread stitching.

Further, the associated midsole 611 is fixedly connected to the foot arch support curved surface block 211 and the spring body 411 through machine stitching or adhesive bonding.

Figure 9:
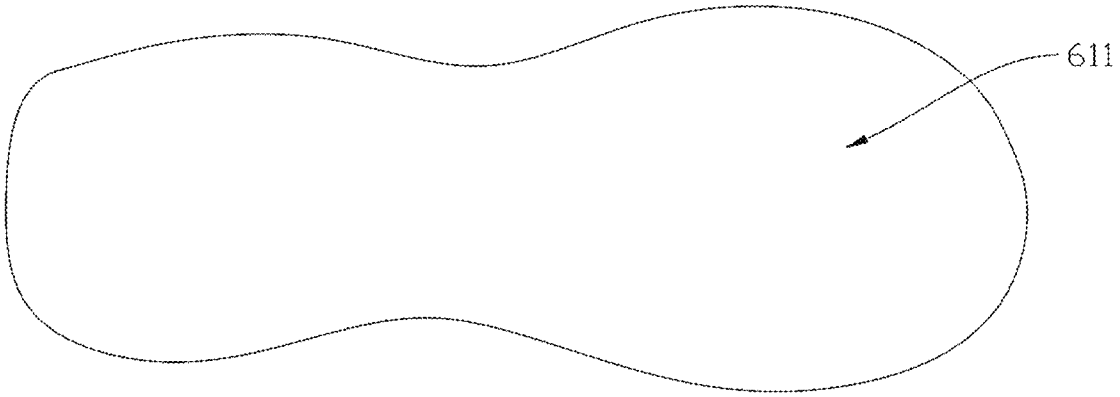
FIG. 9 is a schematic diagram of an enlarged structure of an associated midsole.

Further, the associated midsole 611 is fixedly connected to the interior of the shoe body 111 or a vamp of the shoe body 111 in a thread stitching manner, as shown in FIG. 1, FIG. 2, and FIG. 9.

Figure 10:
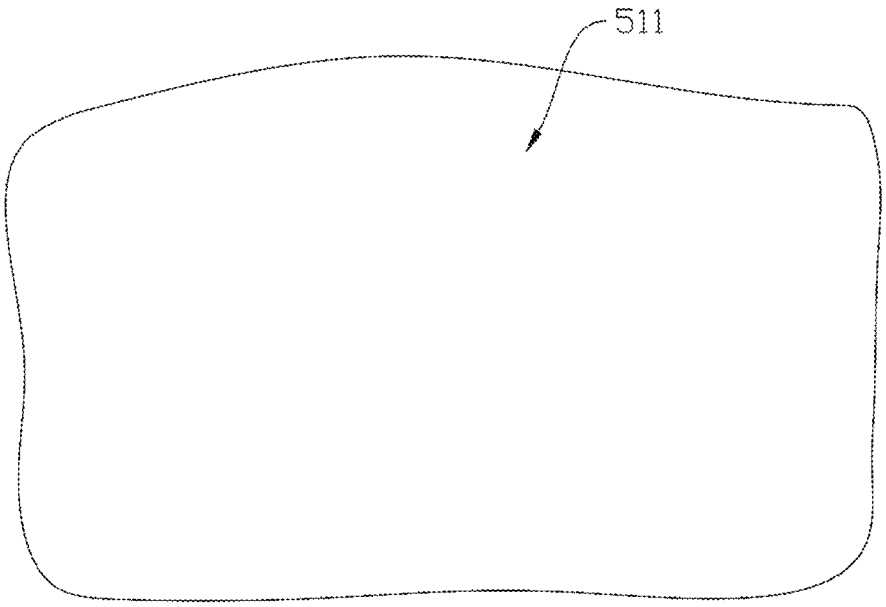
FIG. 10 is a schematic diagram of an enlarged structure of a pressure-bearing plate.

Further, the spring body 411 is made of a high-elasticity material; and the pressure-bearing plate 511 is made of a high support material to ensure the elastic performance and supporting performance of the spring body 411 and the pressure-bearing plate 511, respectively, in conjunction with FIG. 10.

In the present invention, unless otherwise explicitly specified and limited, the terms "mounted", "connected", "connection", "fixed", etc. should be understood in a broad sense, e.g., it may be a fixed connection, a detachable connection or an integral connection; and there are a plurality of detachably mounting manners, for example, by means of an insertion-buckle matched manner, or, by means of a bolt connection manner, etc.

The specific description of the present invention in the above embodiments is merely intended to further describe the present invention, and should not be construed as limiting the scope of protection of the present invention. Any non-essential improvements and adjustments made by those skilled in the art according to the contents of the above invention fall within the scope of protection of the present invention.

What is claimed is:

1. A shoe for automatically adjusting and supporting a foot arch, comprising: a shoe body; an elastic arch support member disposed in an interior of the shoe body and used for foot arch adaptive support, wherein the elastic arch support member comprises an associated midsole, a foot arch support curved surface block disposed on the associated midsole, and a spring body; several elastic straps disposed between an outer edge of the foot arch support curved surface block and the interior of the shoe body, wherein the foot arch support curved surface block is in direct contact with a human body foot arch when worn, the spring body is adapted to an inner bottom of the foot arch support curved surface block, and the spring body and the several elastic straps flexibly adjust a support force at the foot arch jointly; and further comprising a pressure-bearing plate independently disposed between the associated midsole and an inner bottom portion of the shoe body and used for bearing the support force when a gait of the foot arch changes.

2. The shoe for automatically adjusting and supporting a foot arch according to claim 1, wherein the foot arch support curved surface block is adapted to a shape of the human body foot arch when worn, and a thickness of the foot arch support curved surface block gradually decreases from a middle to two ends.

3. The shoe for automatically adjusting and supporting a foot arch according to claim 1, wherein the spring body is disposed at a lower edge of a middle bottom curved surface of the foot arch support curved surface block and has a thickness adapted to the foot arch support curved surface block, and the thicknesses of the spring body and the foot arch support curved surface block gradually decrease from the middle to the two ends.

4. The shoe for automatically adjusting and supporting a foot arch according to claim 1, wherein an outer edge of the foot arch support curved surface block is provided with several connecting members, the several connecting members are in one-to-one correspondence with the several elastic straps, one end of each elastic strap passes through the connecting member to be connected to the foot arch support curved surface block, and the other end of each elastic strap is connected to an inner upper portion of the shoe body.

5. The shoe for automatically adjusting and supporting a foot arch according to claim 1, wherein a connection manner between the elastic strap and the interior of the shoe body may be thread stitching or adhesive connection.

6. The shoe for automatically adjusting and supporting a foot arch according to claim 1, wherein the associated midsole is fixedly connected to the foot arch support curved surface block and the spring body through machine stitching or adhesive bonding.

7. The shoe for automatically adjusting and supporting a foot arch according to claim 1, wherein the associated midsole is fixedly connected to the interior of the shoe body or a vamp of the shoe body in a thread stitching manner.

8. The shoe for automatically adjusting and supporting a foot arch according to claim 1, wherein the spring body is made of a high-elasticity material; and the pressure-bearing plate is made of a high support material.

* * * * *